US006179642B1

(12) United States Patent
Hwang

(10) Patent No.: US 6,179,642 B1
(45) Date of Patent: Jan. 30, 2001

(54) ELECTRICAL CONNECTOR ASSEMBLY HAVING STRAIN-RELIEF

(75) Inventor: Jenq-Yih Hwang, Irvine, CA (US)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/309,541

(22) Filed: May 11, 1999

(51) Int. Cl.[7] ..... H01R 13/627
(52) U.S. Cl. ..... 439/358; 439/492
(58) Field of Search ..... 439/358, 352, 439/353, 387, 389, 399, 497, 492

(56) References Cited

U.S. PATENT DOCUMENTS 4,412,714 * 11/1983 Morningstar et al. ..... 439/352
5,151,049 * 9/1992 Mosquera ..... 439/353
5,613,870 * 3/1997 Traver, Jr. ..... 439/352
5,762,513 * 6/1998 Stein ..... 439/358
5,967,832 * 10/1999 Ploehn ..... 439/497

* cited by examiner

*Primary Examiner*—T. C. Patel

(57) ABSTRACT

An electrical connector assembly comprises a first connector and a second connector mated to the first connector. A strain-relief device is assembled to the second connector for releasably attaching the second connector the first connector. The device includes a base bar having a pair of inner latches extending downward from opposite ends thereof for fixedly engaging with said second housing, a pair of outer latches pivotally attached to said bar for releasably engaging with said mounting recesses of said first housing, a flexible handle bridged between rear ends of said outer latches. When the handle is pulled upward, the outer latches are released from the mounting recesses and further providing easy separation of the second connector with respect to the first connector.

16 Claims, 5 Drawing Sheets

ELECTRICAL CONNECTOR ASSEMBLY HAVING STRAIN-RELIEF

FIELD OF THE INVENTION

The present invention relates to an electrical connector assembly, and more particularly to an assembly having a first connector and a second connector mated to the first connector. Interconnection between the first and second connectors is affirmed by a strain relief having a pair of first latches secured to the second connector and a pair of second latches releasably secured to the first connector.

DESCRIPTION OF PRIOR ART

Conventionally, an IDC connector assembled to an end of a cable is directly plugged to a complimentary connector (normally a header connector) mounted on a printed circuit board. The termination between insulation displacement portions and conductors of the cable is facilitated by a termination cover assembled to the housing of the IDC connector. In order to prevent the termination from being accidentally separated during withdraw of the IDC connector from the header, one of the approach is to provide a strain relief assembled to the termination cover thereby preventing the termination from being damaged during removal of the IDC connector.

Another approach addressed to this problem is to provide a pull-tab assembled to the termination cover. This may also prevent the termination from being separated during removal of the IDC connector.

However, it is desired to ensure the connection between the IDC connector and the header. Therefore, a latch which is easily operated, is expected to be used with an IDC/header connector assembly.

SUMMARY OF THE INVENTION

An objective of this invention is to provide an electrical connector assembly having a first connector and a second connector mated to the first connector. Interconnection between the first and second connectors is affirmed by a strain relief having a handle by which outer latches thereof can be securely fixed in a locked position.

Another objective of this invention is to provide an electrical connector assembly wherein a handle is provided to bridge a pair of outer latches thereby facilitating easy unhook and pull out of the second connector with respect to the first connector.

In order to achieve the objectives set forth, an electrical connector assembly comprises a first connector and a second connector mated to the first connector. A strain-relief device is assembled to the second connector for releasably attaching the second connector the first connector. The device includes a base bar having a pair of inner latches extending downward from opposite ends thereof for fixedly engaging with said second housing, a pair of outer latches pivotally attached to said bar for releasably engaging with said mounting recesses of said first housing, a flexible handle bridged between rear ends of said outer latches. When the handle is pulled upward, the outer latches are released from the mounting recesses and further providing easy separation of the second connector with respect to the first connector.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
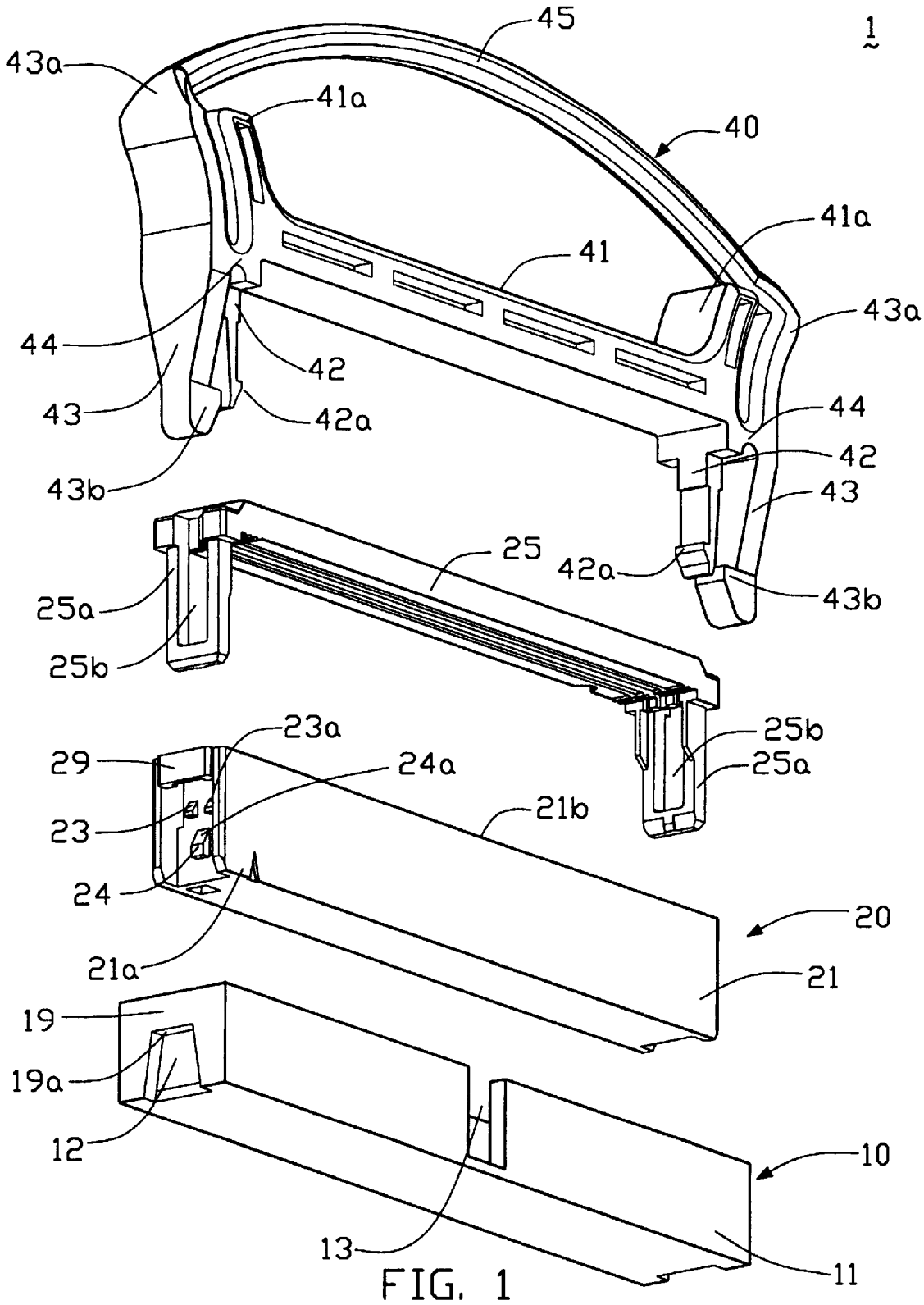
FIG. 1 is a perspective view of an electrical connectors assembly in accordance with the present invention.
Figure 2:
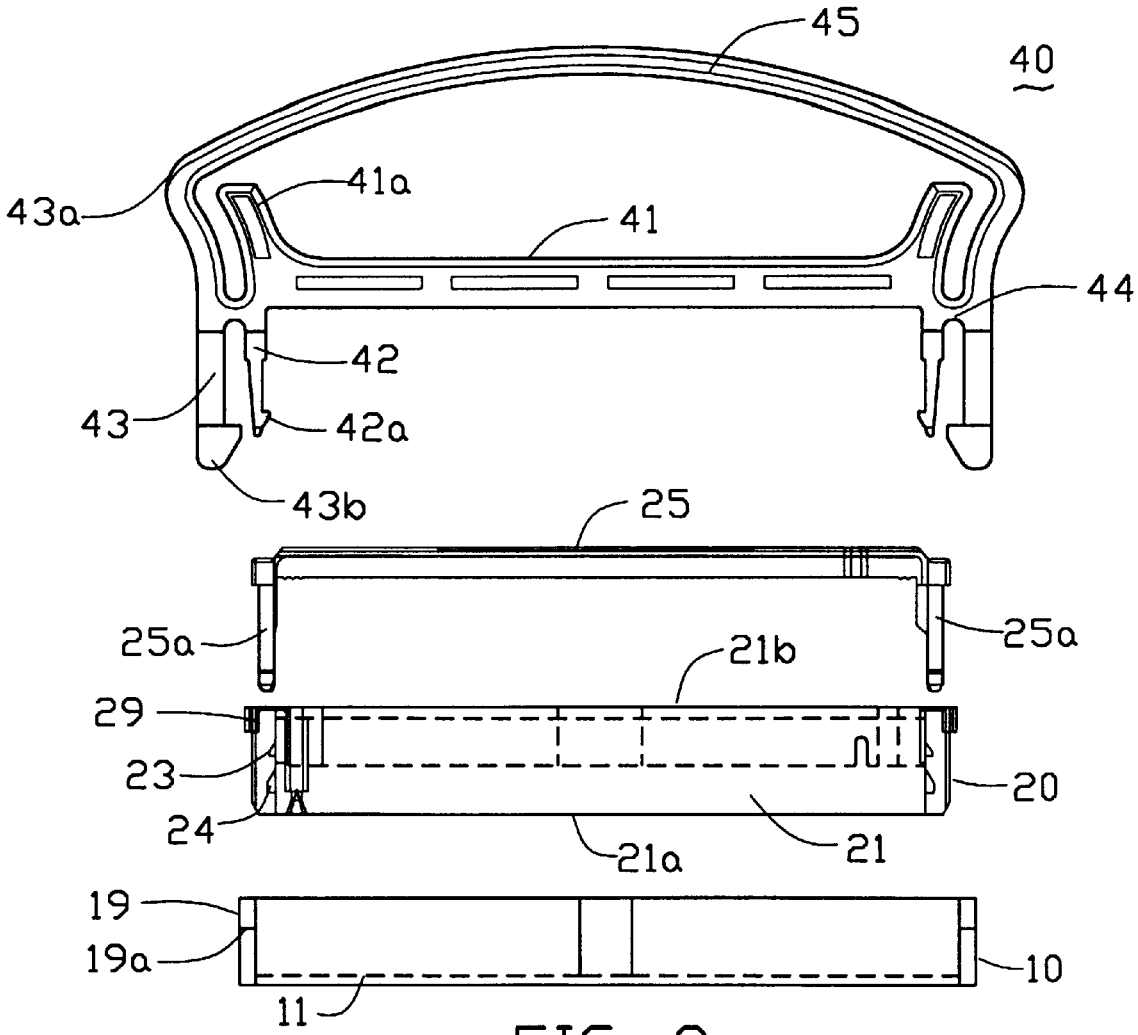
FIG. 2 is a front view of FIG. 1.
Figure 3:
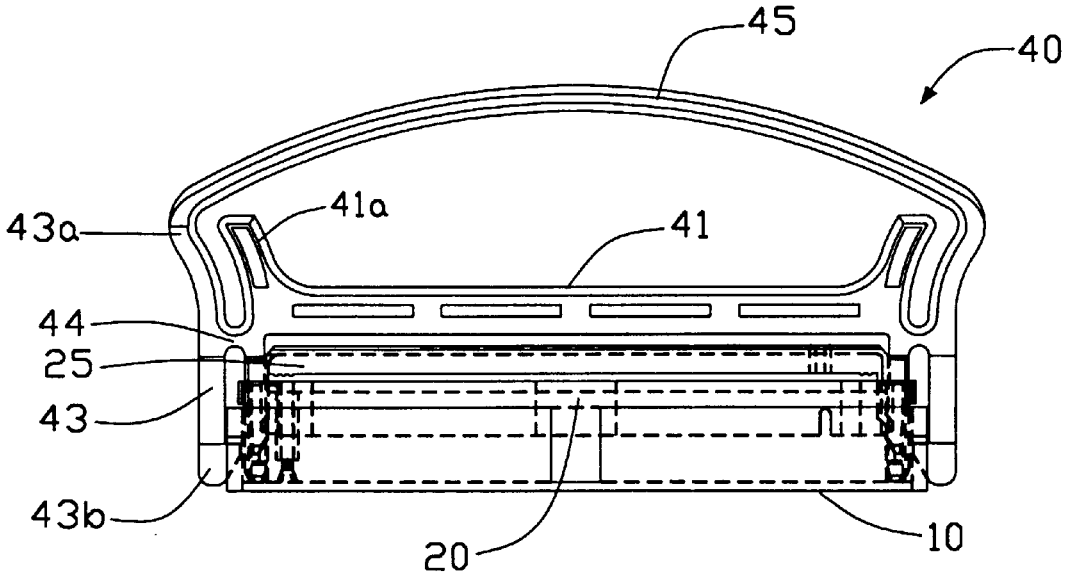
FIG. 3 is an assembled view of FIG. 1.

Referring to FIGS. 1, 2, 3 and 4, an electrical connector assembly 1 in accordance with the present invention comprises a first connector 10 and a second connector 20 mated to the first connector 10. In the preferred embodiment, the first connector 10 is a header and the second connector 20 is a female connector. The header 10 can be assembled to a printed circuit board (not shown). The header 10 includes a first housing 11 defining a pair of mounting recesses 12 by end bars 19 on opposite ends thereof. The housing 11 defines a cavity 13 having an array of pin terminals 14 mounted therein. The pin terminal 14 can be assembled to the housing 11 through a conventional way.

The second connector 20 includes a second housing 21 forming a mating portion 21*a* received in the cavity 13 and a termination face 21*b* opposite to the mating portion 21*a*. An array of insulation-displacement-contact (IDC) terminals 22 is arranged in an array of passageway 23 (only one is shown for simplicity) of the second housing 21. Each IDC terminal 22 has a base portion 22*a* fixedly assembled in the second housing 21, an IDC portion 22*b* extending beyond the termination face 21*b*, and a mating portion 22*c* electrically engaged with the corresponding pin terminal 14 when the second connector 20 is assembled to the header connector 10. Upper and lower anchoring wedges 23 and 24 are formed on opposite ends of the second housing 21. Each wedge 23 (24) includes a guiding surface 23*a* (24*a*).

Figure 4:
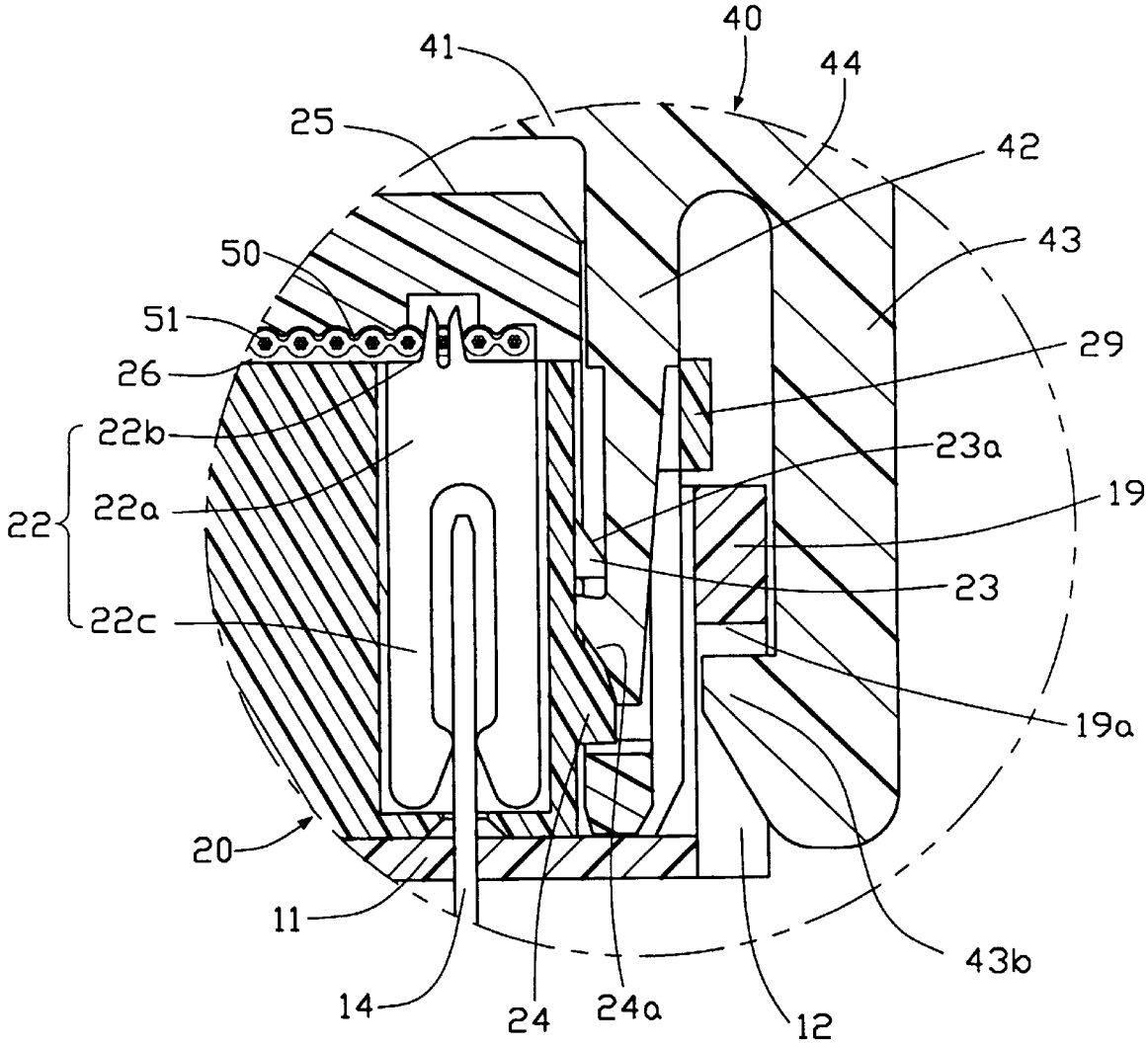
FIG. 4 is an enlarged view of a portion encircled in FIG. 3.

A termination cover 25 is assembled to the termination face 21*b* of the second housing 20 for performing terminations between the IDC portions 22*b* and conductors 51 of a flat cable 50. The cover 25 includes a pair of mounting lugs 25*a* fixedly engaged to the lower anchoring wedges 24 of the second housing 20. The mounting lug 25*a* defines a passage 25*b* therein. In assembly, the mounting lugs 25*a* rest firstly on the upper wedges 23 thereby providing a gap 26 between the cover 25 and the termination face 21*b* for insertion of the RIBBON cable 50 (FIG. 4). Then the termination cover 25 is moved downward to engage with the lower wedge 24 thereby facilitating termination between the conductors 51 of the RIBBON cable 50 and the IDC portion 22*b* of the terminal 22.

A strain-relief device 40 is assembled to the termination cover 25 and includes a base bar 41 having a pair of inner latches 42 extending downward from opposite ends thereof for fixedly engaging with the upper wedges 23 of the second housing 20. The inner latch 42 includes a hook 42*a* engaged to the upper mounting wedges 23. In assembly, the inner latch 42 is received in the passage 25*b* in the mounting lug 25*a* and engaged to the upper mounting wedges 23. A pair of outer latches 43 is pivotally attached to the base bar 41 for releasably received in the mounting recesses 12 of the first housing 10 by a flexible hinge 44 and engaging a lower edge

19*a* of the end bar 19 thereof. The flexible hinge 44 serves as a fulcrum thereby the outer latch 43 may conduct a pivotal movement centered on the hinge 44. Rear ends 43*a* of the outer latches 43 are bridged by a flexible handle 45. When the handle 45 is pulled upwardly, the rear ends 43*a* will be moved toward each other thereby causing hooks 43*b* of the outer latches 43 to open widely as centered on the hinge 44. In other words, a simple upward pulling of the strain relief 40, may simultaneously release the latch 43 from the first connector 10, and withdraw the second connector 20 from the first connector 10. In opposite, if no upward pulling force is applied thereto, the handle 45 is resumed to its original position thereby pushing the rear ends 43*a* away each other thereby causing hooks 43*b* of the outer latches 43 to engage to the edge 19*a* of the end bar 19 of the header connector 10. By the provision of the handle 45 bridging between the two outer latches 43, retaining force thereof can be further enhanced, thus assuring securement between the header 10 and the connector 20 with its associated strain relief 40.

The base bar 41 further includes a pair of horns 41*a* extending vertically and outward thereof for limiting inward movement of the rear ends 43*a* of the outer latches 43.

Figure 5:
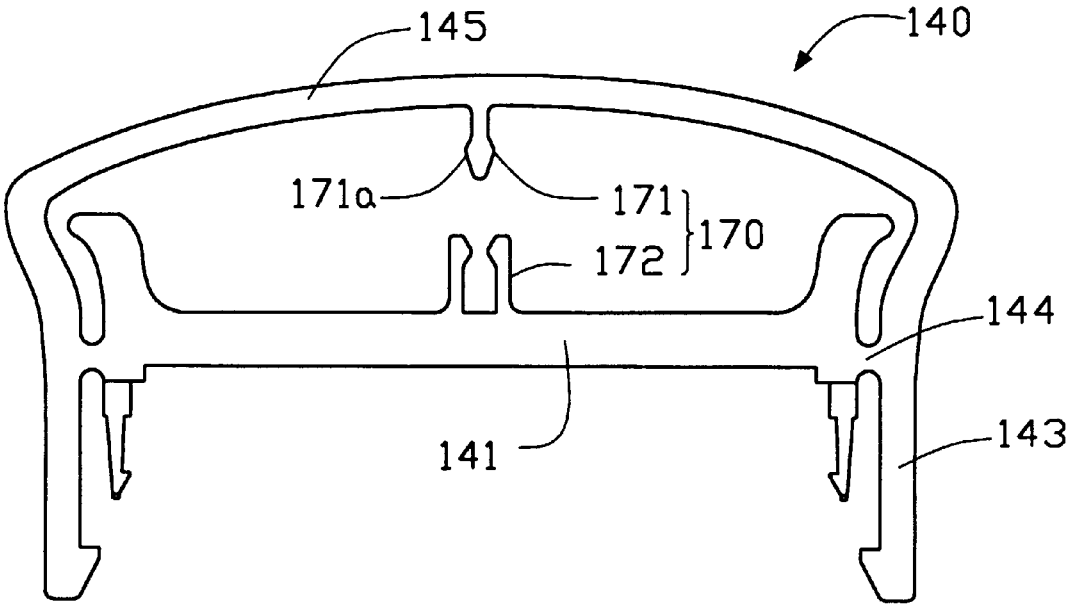
FIG. 5 is a handle in accordance with a second embodiment of the present invention.
Figure 6:
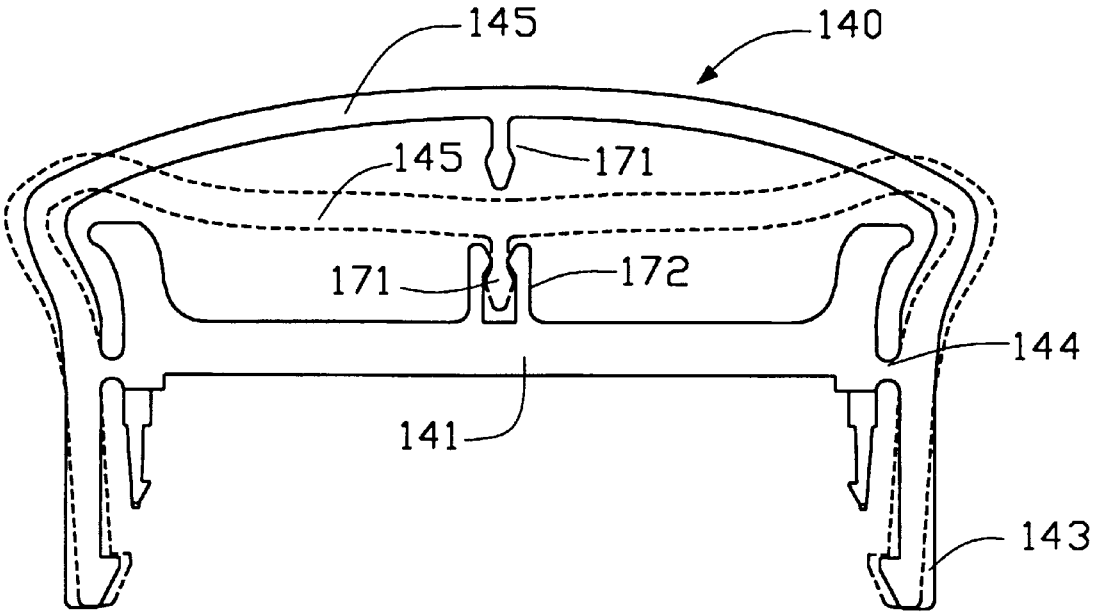
FIG. 6 shows the handle is fixed in a locked position.
Figure 7:
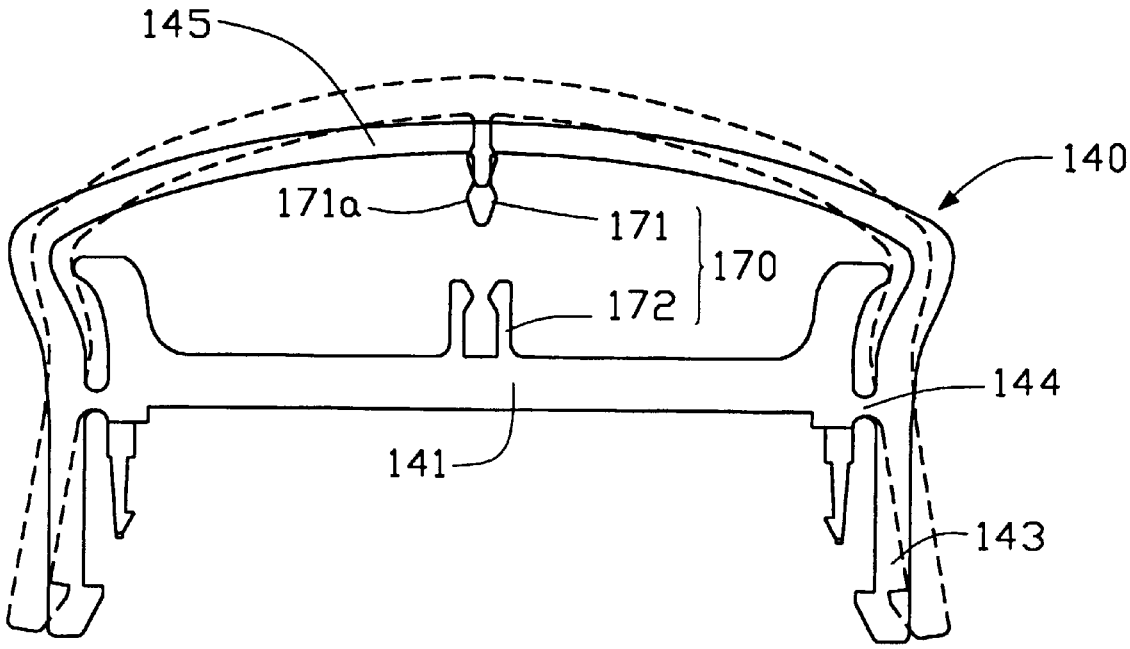
FIG. 7 shows latches are located in an unlocked position.

Referring to FIGS. 5 and 6, a strain relief 140 in according to a second embodiment of the present invention is shown. The strain relief 140 is similar to the strain relief 40 except locking means 170 is formed between the handle 145 and the base bar 141. The locking means 170 includes a post 171 formed on the handle 145 and a retaining socket 172 formed on the base bar 141. The post 171 has an enlarged head 171*a* fixedly received in the retaining socket 172. By this arrangement, the hinge 144 can be made smaller such that no biasing force is exerted to the outer latches 143. This is advantageous because it provides a zero-insertion-force arrangement between the outer latches 143 and the mounting recesses 12. The engaging force of the outer latches 143 is completely exerted by the handle 145 when the post 171 is securely to the socket 172 thereby enhancing the electrical connection between the second connector 20 and the header 10. In addition, when the post 171 is locked to the socket 172, the outer latches 143 are also received in the mounting recesses 12 and engaged to the lower edge 19*a* of the end bar 19 thereby preventing accidental release of the strain relief 140. In this embodiment, the locking means 170 is to maintain the outer latches 143 in a locking manner. Understandably, in another embodiment, such a locking means may be reversely designed to maintain the latches in a unlocking manner for easy disengagement and withdrawal of the strain relief from the header.

It can be also understood that the hook 42*a* of the inner latch 42 of the strain relief 40 extends inward for latchable engagement with the upper wedge 23 of the housing 21, thereby securing the strain relief 40 to the housing 21. It can be noted, if the inner latch of the strain relief is directed outward and engaged with the outermost end bar of the second housing of the IDC connector, the outermost end bar of the second housing can not help but be inward offset from the outermost end bar of the first housing of the header connector for providing a space thereabout to receive the outward projecting inner latch therein, thus increasing the lengthwise dimension of the whole assembly. In contrast, referring to FIG. 4, because there is no need to offset these two outermost end bars, the outermost end bar 29 of the second housing 21 of the IDC connector 20 is substantially positioned above the outermost end bar 19 of the first housing 11 of the header 10 in an overlapping state, thereby minimizing the lengthwise dimension of the whole assembly. From another viewpoint, the upper wedge 23 can be used to first temporarily hold the cover 25 at the upper level for installation of the ribbon cable 50, while later to engage with the inner latch 42 of the strain relief 40 for securing the strain relief 40 to the second housing 21.

Although the present invention has been described with reference to the preferred embodiments, it is apparent to those skilled in the art that a variety of modifications and changes may be made without departing from the scope of the present invention which is intended to be defined by the appended claims.

I claim:

1. An electrical connector assembly, comprising:

a first connector adapted to be assembled to a printed circuit board, said first connector including a first housing defining a pair of mounting recesses on opposite ends thereof, said first housing defining a cavity having an array of a pin terminals mounted therein;

a second connector assembled to said first connector, said second connector including a second housing forming a mating portion received in said cavity and a termination face opposite to said mating portion, an array of insulation-displacement-contact (IDC) terminals arranged in said second housing, each IDC terminal having a base portion fixedly assembled in said second housing, an IDC portion extending beyond to said termination face, and a mating portion electrically engaged with said corresponding pin terminal when said second connector is assembled to said first connector, upper and lower anchoring wedges formed on opposite ends of said second housing; a terminal cover assembled to said termination face of said second housing for performing terminations between said IDC portions and conductors of a flat cable, said cover including a pair of mounting lugs assembled to said lower anchoring wedges of said second housing; and a strain-relief device assembled to said termination cover, said device including a base bar having a pair of inner latches extending downward from opposite ends thereof for fixedly engaging with said second housing, a pair of outer latches pivotally attached to said bar for releasably engaging with said mounting recesses of said first housing, a flexible handle bridged between rear ends of said outer latches.

2. The electrical connector assembly as recited in claim 1, wherein said base bar includes a pair of horns extending vertically and outward thereof for limiting inward movement of said rear ends of said outer latches.

3. The electrical connector assembly as recited in claim 1, wherein said outer latch includes a hook engaged to an edge of said mounting recess.

4. The electrical connector assembly as recited in claim 1, wherein said inner latch includes a hook engaged to said upper mounting wedges.

5. The electrical connector as recited in claim 1, wherein locking means is formed between said handle and said base bar such that said handle can be securely attached to said termination cover.

6. The electrical connector as recited in claim 5, wherein said locking means includes a post formed on said handle and a retaining socket formed on said base bar.

7. The electrical connector as recited in claim 6, wherein said post includes an enlarged head.

8. An electrical connector assembly comprising:

an header including a first housing with at least an outermost end bar positioned at one end;

an IDC connector including a second housing with an upper first wedge and a lower second wedge around at one end;

a termination cover latchably engaged with the second wedge for securing the termination cover to the second housing;

a strain relief including at least an inner latch and an outer latch at one end; wherein the inner latch engages with the first wedge for securing the strain relief to the second housing, and the outer latch engages with the outermost end bar for securing the strain relief to the first housing; wherein the inner latch includes a first hook, the outer latch includes a second hook, and both said first hook and said second hook extend in a same inward direction.

9. The assembly as recited in claim 8, wherein the second housing includes another outermost end bar substantially positioned above said outermost end bar of the first housing.

10. An electrical connector assembly comprising:

a first connector defining at least an engaging bar at one end;

a second connector engaged with the first connector; and at least a fastening device attached to the second connector and including a latch adapted to be latchably engaged with the engaging bar, said first fastening device including means for disengaging and further removing the fastening device from the first connector; whereby via an upward pulling action upon said means, the second connector can be removed from the first connector, wherein said means includes a handle integrally connected to the latch of the fastening device, so that the latch of the fastening device is actuated to move pivotably for disengagement from the engaging bar when an upward force is applied to said handle.

11. The assembly as recited in claim 10, wherein two latches are provided at two opposite ends of the fastening device, and said handle is bridged between said two latches.

12. An electrical connector assembly comprising:

a first connector defining at least an engaging bar at one end;

a second connector engaged with the first connector; and at least a fastening device attached to the second connector and including a latch adapted to be latchably engaged with the engaging bar, said fastening device including first means for disengaging and further removing the fastening device from the first connector, and second means for maintaining said latch in one of locking or unlocking manner with regarding to the engaging section; wherein said fastening device includes a pair of latches positioned at two opposite ends, said first means is a handle integrally connected between said two latches, said second means includes a post extending downward from the handle, and a retaining socket extending upward from the fastening device for receiving said post therein.

13. The assembly as recited in claim 12, wherein when said second means is activated, the first means is actuated to have the latch in a locking manner; when the second means is not activated, the latch imposes a zero insertion/withdrawal force upon the first connector.

14. A strain relief for use with an IDC connector for connecting to a header, comprising:

a base bar horizontally extending along a lengthwise direction;

a pair of inner latches respectively positioned at two opposite ends of the base bar and adapted to latchably engage the IDC connector; and a pair of outer latches respectively positioned at two opposite ends of the base bar spatially outside the corresponding inner latches, and adapted to latchably engage the header; wherein the inner latch has a first hook, the outer latch has a second hook, and both of said first hook and said second hook extend in a same inward direction.

15. The strain relief as recited in claim 14, wherein a handle is integrally connected between said two outer latches.

16. An electrical connector assembly comprising:

a first connector defining at least an engaging bar at one end;

a second connector engaged with the first connector; and at least a fastening device attached to the second connector and including a latch adapted to be latchably engaged with the engaging bar, said fastening device including first means for disengaging and further removing the fastening device from the first connector, and second means for maintaining said latch in one of locking or unlocking manner with regarding to the engaging section; wherein when said second means is activated, the first means is actuated to have the latch in a locking manner; when the second means is not activated, the latch imposes a zero insertion/withdrawal force upon the first connector.

* * * * *